US011802732B2

(12) United States Patent
Oo

(10) Patent No.: US 11,802,732 B2
(45) Date of Patent: Oct. 31, 2023

(54) SYSTEMS AND METHODS FOR VACUUM FURNACE POST-PROCESSING

(71) Applicant: Raytheon Technologies Corporation, Farmington, CT (US)

(72) Inventor: Guolin Oo, Singapore (SG)

(73) Assignee: RTX Corporation, Farmington, CT (US)

( * ) Notice: Subject to any disclaimer, the term of this patent is extended or adjusted under 35 U.S.C. 154(b) by 256 days.

(21) Appl. No.: 17/187,105

(22) Filed: Feb. 26, 2021

(65) Prior Publication Data

US 2022/0276006 A1 Sep. 1, 2022

(51) Int. Cl.
*F27D 21/02* (2006.01)
*F27D 7/06* (2006.01)

(52) U.S. Cl.
CPC ..... *F27D 21/02* (2013.01); *F27D 7/06* (2013.01); *F27D 2007/066* (2013.01); *F27D 2021/026* (2013.01)

(58) Field of Classification Search
CPC ..... F27D 21/02
See application file for complete search history.

(56) References Cited

U.S. PATENT DOCUMENTS 3,019,006 A * 1/1962 Lillienberg ..... C21D 9/663 432/209
3,199,854 A * 8/1965 Ipsen ..... C21D 1/767 432/235
4,830,610 A * 5/1989 Hemsath ..... C21D 9/665 432/175
6,002,993 A * 12/1999 Naito ..... C10B 41/00 382/141
7,641,402 B2 1/2010 Kocanda et al.
8,199,193 B2 6/2012 Kolek et al.
8,630,924 B2 * 1/2014 Groenevelt ..... G06Q 10/087 283/79
2008/0308551 A1 * 12/2008 Wilcox ..... F27B 14/08 219/634
2009/0063307 A1 3/2009 Groenovelt et al.

FOREIGN PATENT DOCUMENTS

| | | |
|---|---|---|
| CN | 105588439 | 5/2016 |
| CN | 210321209 | 4/2020 |
| CN | 112097520 | 12/2020 |
| KR | 200301049 | 4/2003 |

OTHER PUBLICATIONS

European Patent Office, European Search Report dated Jun. 20, 2022 in Application No. 22158326.3.
European Patent Office, European Office Action dated Jul. 14, 2023 in Application No. 22158326.3.

* cited by examiner

*Primary Examiner* — Jason Lau
(74) *Attorney, Agent, or Firm* — SNELL & WILMER L.L.P.

(57) ABSTRACT

A method of generating a loaded layout in a vacuum furnace corresponding to an actual layout in the vacuum furnace during operation of the vacuum furnace may comprise receiving, via a processor, a visual data of a loading process of the vacuum furnace from a camera; comparing, via the processor, the visual data to a predetermined maximum capacity layout for the vacuum furnace; and arranging, via the processor, the visual data into the loaded layout in response to comparing the visual data.

20 Claims, 4 Drawing Sheets

SYSTEMS AND METHODS FOR VACUUM FURNACE POST-PROCESSING

FIELD

The present disclosure relates to systems and methods related to aircraft component repair processes, more specifically, systems and methods for vacuum furnace post-processing.

BACKGROUND

Vacuum furnaces may often be used in repair processes for aerospace components and assemblies, such as brazing, heat treatment vacuum cleaning, annealing, and sintering. Components to be process may be loaded into baskets, and stacked in the furnace to maximize loading capacity prior to the repair process. After the repair process within a respective vacuum furnace, the baskets may be removed from the furnace and inspected. Information regarding location and placement of the respective components and baskets may be lost after removal from the vacuum furnace.

SUMMARY

A method of generating a loaded layout in a vacuum furnace corresponding to an actual layout in the vacuum furnace during operation of the vacuum furnace is disclosed herein. The method may comprise: receiving, via a processor, a visual data of a loading process of the vacuum furnace from a camera; comparing, via the processor, the visual data to a predetermined maximum capacity layout for the vacuum furnace; and arranging, via the processor, the visual data into the loaded layout in response to comparing the visual data.

In various embodiments, the method may further comprise sending, via the processor, the loaded layout to a display device. The method may further comprise storing, via the processor, the loaded layout for a batch load in the furnace for at least one of traceability, root cause analysis, or quality investigations. The visual data may include a visual image for each row of components disposed in the vacuum furnace, and the loaded layout displayed on the display device may include the visual image for each row corresponding a respective location a component in the visual image was in the vacuum furnace. The visual data may be video data. The loaded layout may include a two-dimensional image. The loaded layout may include a three-dimensional image.

A method is disclosed herein. The method may comprise: capturing a visual data of a vacuum furnace loading process, the visual data including a first image of a first row of components disposed on a loading stand and a second image of a second row of components disposed on the loading stand in the vacuum furnace, the loading stand configured to be placed in a vacuum furnace; and arranging the first image and the second image into a layout image, the layout image including the first image, the second image, and location indicators, the location indicators corresponding to a position of components within the vacuum furnace during operation of the vacuum furnace.

In various embodiments, capturing the visual data may be captured via a camera. The visual data may be video data. The first image and the second image may be captured as still images. The layout image may be a three-dimensional image. The first row of components may include a first basket with a first set of components and a second basket with a second set of components. The first set of components may be different from the second set of components.

A control system for vacuum furnace post processing is disclosed herein. The control system may comprise: a camera configured to be disposed with a line of sight to a loading stand; a controller configured to operably couple to the camera, the controller configured to: receive, through the camera, visual data corresponding to a loading process of a plurality of baskets on the loading stand, each basket in the plurality of baskets having a component disposed therein; and arrange the visual data into a loaded layout, the loaded layout corresponding to an actual layout of the plurality of baskets during after the loading process.

In various embodiments, the controller may be further configured to compare the visual data to a predetermined maximum capacity layout prior to arranging the visual data. Arranging the visual data into the loaded layout may be in response to comparing the visual data to the predetermined maximum capacity layout. The control system may further comprise a plurality of cameras, the plurality of cameras including the camera. The controller may further be configured to generate a three-dimensional image for the loaded layout. The plurality of baskets may include a first row of baskets and a second row of baskets, the first row of baskets disposed between the loading stand and the second row of baskets.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
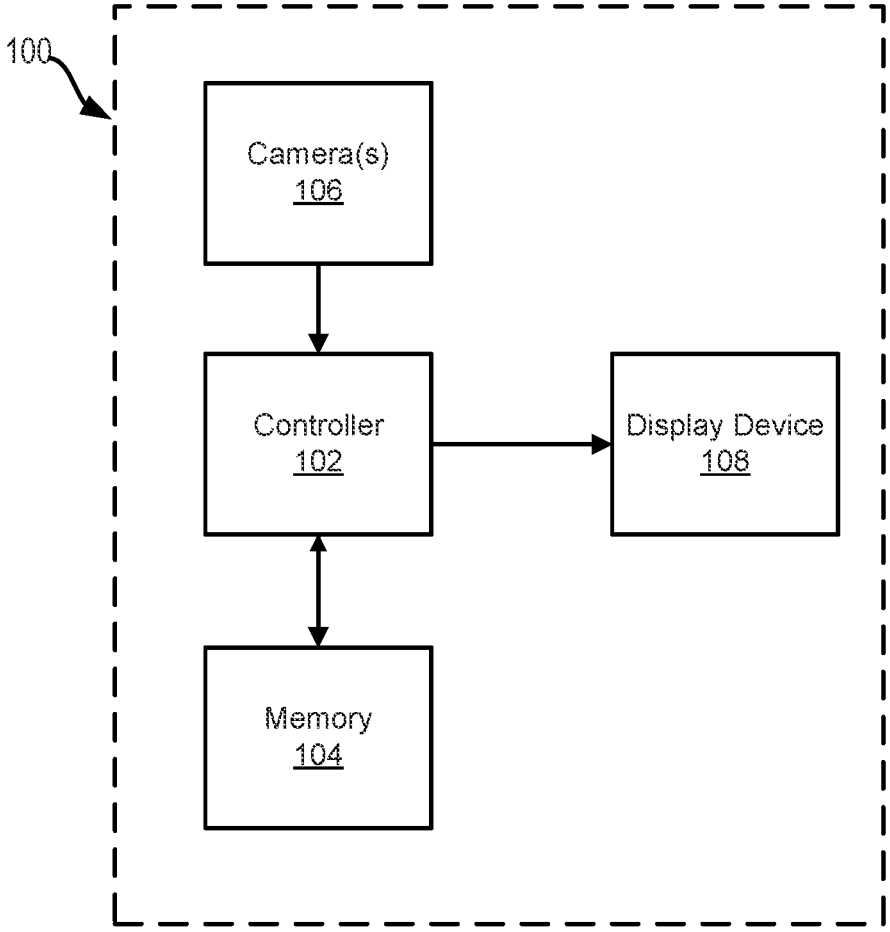
FIG. 1 illustrates a control system for vacuum furnace post-processing, in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Disclosed herein are systems and methods for vacuum furnace post-processing. In particular, the system may include a controller in operable communication with a camera. A "camera" as disclosed herein refers to a device for recording visual images in the forms of photographs, film or video signals. In various embodiments, a lens of the camera is aligned into a vacuum furnace for an aircraft repair process (i.e., brazing, heat treatment, vacuum cleaning, annealing, sintering, etc.). In various embodiments, the controller is configured to receive visual data from the camera. In various embodiments, visual data may correspond to various images captured during a loading process (i.e., loading a plurality of components into the vacuum furnace). In various embodiments, the controller is further configured to arrange the visual data captured and match the visual data to an arrangement of the plurality of components within the vacuum furnace after loading. In other words, the controller may arrange the visual data and send an arranged image to a display device. In various embodiments, the arranged image may correspond to a 2-dimensional image (2-D) or a 3-dimensional (3-D) image of the plurality of components as they were loaded in the vacuum furnace. In various embodiments, the 2-D or 3-D output by the controller may comprise a loaded layout within the furnace. In this regard, whether a component was disposed proximate a front, rear, bottom, top, or middle of the vacuum furnace may be determined from the loaded layout.

In various embodiments, the systems and methods disclosed herein may provide visual records of components loaded within a vacuum furnace, in accordance with various embodiments. In various embodiments, the loaded layout may allow visualization and referencing of a position in which components or baskets are loaded in the vacuum furnace. In various embodiments, the systems and methods may further allow better traceability during post-processing root cause analysis, quality investigations or the like.

Referring now to FIG. 1, a schematic view of a control system 100 for vacuum furnace post-processing is illustrated, in accordance with various embodiments. The control system 100 includes a controller 102, memory 104 (e.g., a database or any appropriate data structure; hereafter "memory 104" also may be referred to as "database 104"), and a camera 106. The controller 102 may include one or more logic devices such as one or more of a central processing unit (CPU), an accelerated processing unit (APU), a digital signal processor (DSP), a field programmable gate array (FPGA), an application specific integrated circuit (ASIC), or the like (e.g., controller 102 may utilize one or more processors of any appropriate type/configuration, may utilize any appropriate processing architecture, or both). In various embodiments, the controller 102 may further include any non-transitory memory known in the art. The memory 104 may store instructions usable by the logic device to perform operations. Any appropriate computer-readable type/configuration may be utilized as the memory 104, any appropriate data storage architecture may be utilized by the memory 104, or both.

The database 104 may be integral to the control system 100 or may be located remote from the control system 100. The controller 102 may communicate with the database 104 via any wired or wireless protocol. In that regard, the controller 102 may access data stored in the database 104. The database 104 may be configured to store images (i.e., 2D or 3D images) of loaded layouts for vacuum furnace post-processing as described further herein.

In various embodiments, the camera 106 may be in operable communication with the controller 102. For example, the camera 106 may be operably coupled to the camera 106 via a network, a router, an electrical cable, or the like. In various embodiments, the camera 106 is configured to obtain visual data during loading of a vacuum process, as described further herein. In various embodiments, a user may manually operate the camera 106, or automatically through the controller 102. In various embodiments, the controller 102 may be operated through at least one other controller that is separate and distinct from controller 102. In various embodiments, the camera 106 may be coupled to controller 102 after the fact (e.g., post-processing).

In various embodiments, the camera 106 may be positioned vertically above a loading stand within a furnace as described further herein. In various embodiments, the control system 100 may include a plurality of the camera 106. In this regard, visual data may be obtained from each camera 106 in a plurality of cameras 106. In various embodiments, the controller 102 may be configured to receive the visual data and send a loaded layout (e.g., a 2D or 3D image) of a respective loaded vacuum furnace to be used for post processing, as described further herein.

In various embodiments, the control system 100 may further comprise a display device 108 in operable communication with the controller 102. A display device 108 may comprise a phone, a tablet, an iPad®, a laptop, a monitor, and/or any other suitable electronic device. In various embodiments, a display device 108 may comprise an iPhone®, a Blackberry®, a device running an Android® operating system, a Nokia® phone, a Windows® phone, and/or any other data access and/or telephony device.

Figure 2A:
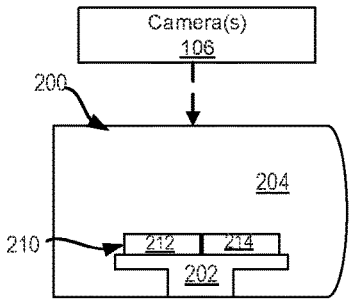
FIG. 2A illustrates a first step in a loading process of a vacuum furnace, in accordance with various embodiments.

Referring now to FIG. 2A, a first step in a vacuum furnace loading process is illustrated, in accordance with various embodiments. In various embodiments, a vacuum furnace 200 may be in accordance with any vacuum furnace known in the art. For example, vacuum furnace 200 may comprise a vacuum vessel, a hot zone, a pumping system, a cooling system, a control system (e.g., temperature and vacuum), and/or a handling system. In various embodiments, vacuum furnace 200 is a vertically loaded vacuum furnace. Although illustrated as a vertically loaded vacuum furnace, the present disclosure is not limited in this regard. For example, the vacuum furnace may be a horizontal loaded vacuum furnace in accordance with various embodiments. In various embodiments, the loading stand 202 may be inside the vacuum furnace 200 during loading or outside the vacuum furnace 200 during loading. The present disclosure is not limited in this regard. For example, the various components may be loaded onto the loading stand 202 outside of the vacuum furnace 200 and then the loading stand 202 is placed in the vacuum furnace 200 thereafter.

In various embodiments, camera(s) 106 may have a line of sight to a loading stand 202 disposed within a housing 204 of the vacuum furnace 200. For example, camera(s) 106 may be mounted adjacent to a door to the housing, the camera(s) 106 may be placed within the furnace during loading (e.g., via a mounting mechanism, a tripod, etc.) and removed prior to operation, the camera(s) 106 may be held and operated by a user during loading, or the like.

Figure 2B:
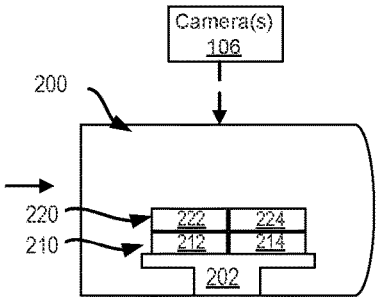
FIG. 2B illustrates a second step in a loading process of a vacuum furnace, in accordance with various embodiments.
Figure 2C:
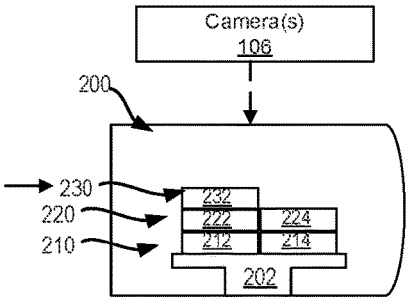
FIG. 2C illustrates a third step in a loading process of a vacuum furnace, in accordance with various embodiments.

During loading of a vacuum furnace 200, visual data is obtained by the camera 106 throughout the loading process. For example, in response to a first row of components 210 being loaded (e.g., a first basket of components 212 and a second basket of components 214 as shown in FIG. 2A), camera(s) 106 may capture a first visual image. Similarly, in response to a second row of components 220 being loaded (e.g., a third basket of components 222 and a fourth basket of components 224 as shown in FIG. 2B), camera(s) 106 may capture a second visual image. Additionally, in various embodiments, in response to a third row of components 230 (e.g., fifth basket 232 as shown in FIG. 2C), camera(s) 106 may capture a third visual image.

In various embodiments, a visual image may be captured by camera(s) 106 manually by a user or automatically by detecting a row of components being loaded, a basket of components being loaded, or the like. For example, in various embodiments, the system 100 from FIG. 1 may further comprise a sensor configured to detect when a row of components and/or a basket of components has been loaded on the loading stand 202, in accordance with various embodiments. For example, a sensor could include a radio frequency identification (RFID) reader and each basket (e.g., baskets 212, 214, 222, 224, 232, etc.) may comprise an RFID tag (although any appropriate data storage device/reader may be utilized). Thus, in response to an RFID reader sensing an RFID tag, the camera(s) 106 may capture a visual image of the basket on the loading stand during loading, or the like. In various embodiments, the sensor could comprise a weight sensor on the loading stand 202 configured to send a signal to the camera to take a picture in response to a weight detected by the sensor increasing. In various embodiments, a visual image may be delayed in response to a change in weight being detected (e.g., 5 seconds, 10 seconds, or the like).

Figure 3:
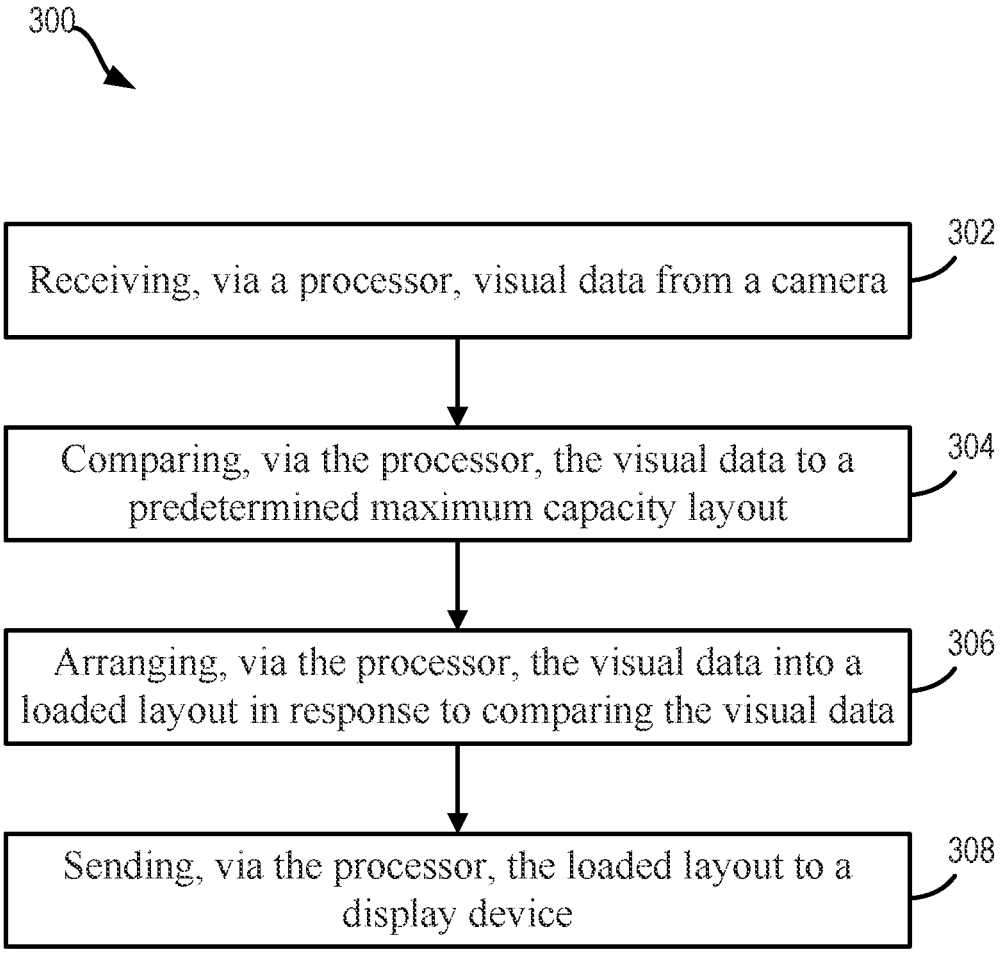
FIG. 3 illustrates a method of generating a loaded layout for a vacuum furnace, in accordance with various embodiments.

Referring now to FIG. 3, a method 300 of producing a loaded layout of components (or baskets of components) is illustrated, in accordance with various embodiments. In various embodiments, the method 300 comprises receiving, via a processor, visual data from a camera (step 302). In various embodiments, the visual data may be received from a single camera or a plurality of cameras. In various embodiments, the visual data may include a visual image of each row of components disposed in a vacuum furnace, as illustrated in FIGS. 2A-2C. For example, the visual data may include a first image showing a first row of components (e.g., first row of components 210 from FIG. 2A), a second image showing a second row of components (e.g., second row of components 220 from FIG. 2B), and a third image showing a third row of components (e.g., third row of components 230 from FIG. 2C). In various embodiments, the visual data may be video data. In this regard, the loading process (e.g., FIGS. 2A-2C) may be captured via video by the camera(s) (e.g., camera(s) 106 from FIGS. 1-2C).

The method 300 may further comprise comparing, via the processor, the visual data to a predetermined maximum capacity layout (step 304). In various embodiments, components being repaired for gas turbine engines as described herein may be placed in containers, baskets, or some type of component configured to at least partially house the component being repaired within the vacuum furnace. For example, a basket may be configured to at least partially house a first set of components (e.g., baskets 212, 214, 222, 224, 232 from FIGS. 2A-C). In various embodiments, a predetermined maximum capacity layout may comprise X number of baskets wide, by Y number of baskets long by Z number of baskets high. For example, a predetermined maximum capacity layout may comprise two baskets wide by one basket long by three baskets high for vacuum furnace 200 from FIGS. 2A-2C, in various embodiments. Although described as having a specific size, the present disclosure is not limited in this regard. For example, various predetermined maximum capacity layout sizes are within the scope of this disclosure.

In various embodiments, the method 300 further comprises arranging, via the processor, the visual data into a loaded layout in response to comparing the visual data (step 306). In various embodiments, the loaded layout may match an actual layout of the components within the vacuum furnace (i.e., during operation of the vacuum furnace 200 from FIGS. 2A-2C). In various embodiments, in response to an actual layout having less baskets relative to the predetermined maximum capacity layout, the loaded layout may show a placeholder image, or the like, where a basket was missing in the actual layout of the vacuum furnace.

In various embodiments, the method 300 further comprises sending, via the processor, the loaded layout to a display device (step 308). In this regard, the method 300 may allow visualization by a user looking to post-process a batch in a vacuum furnace when root cause analysis, quality investigations, or the like are desired.

In various embodiments, the loaded layout produced from method 300 may allow visualization and referencing of a position in which components or baskets are loaded in the vacuum furnace. In various embodiments, the method 300 may further allow better traceability during post-processing root cause analysis, quality investigations or the like.

Figure 4:
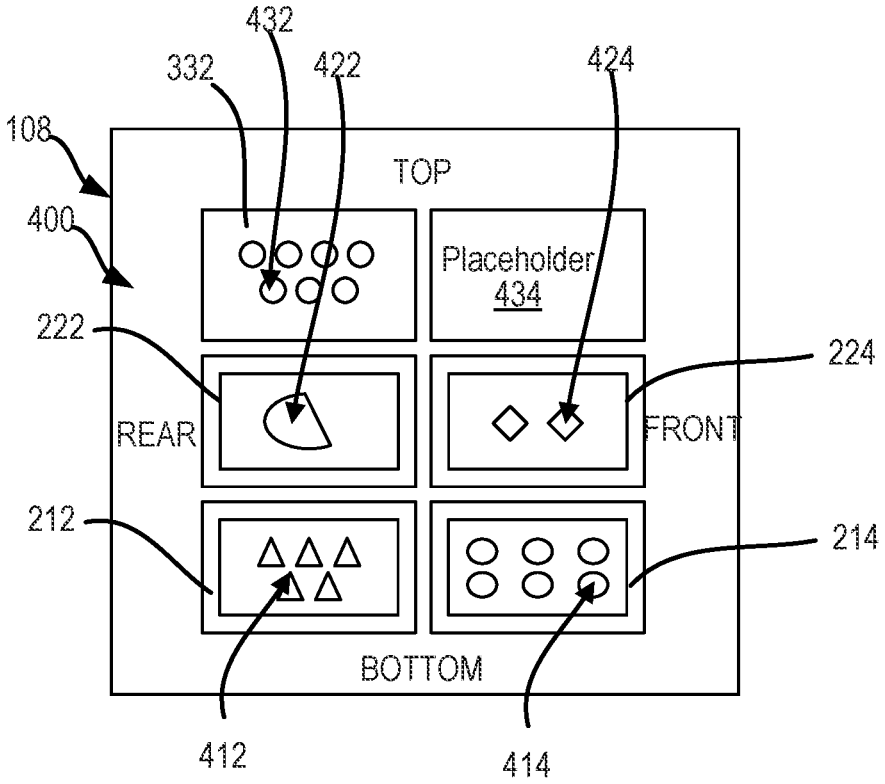
FIG. 4 illustrates a display device of a control system showing a loaded layout, in accordance with various embodiments.

Referring now to FIG. 4, a display device 108 displaying the loaded layout 400 from loading a vacuum furnace as illustrated in FIG. 2 and sent to the display device 108 via the processor in step 308 of method 300 is illustrated, in accordance with various embodiments. In various embodiments, the display device 108 may display the loaded layout 400 produced in step 306 and the loaded layout 400 may be sent in step 308 of method 300. The loaded layout 400 may include images of each basket (e.g., baskets 212, 214, 222, 232) disposed in a location of the vacuum furnace corresponding to an actual location of the respective basket in the vacuum furnace during operation of the vacuum furnace. In various embodiments, each basket may have a component (e.g., component 422), or a set of components (e.g. sets of components 412, 414, 424, 432) disposed therein. As described with respect to step 306 for method 300, as actual loaded capacity was less than a maximum loaded capacity, a placeholder image 434 may be disposed where a sixth basket may have been placed, in accordance with various embodiments. In various embodiments, the components disposed in the various baskets may be all the same components, all different components, or anywhere in between. The present disclosure is not limited in this regard. Although illustrated as a 2-D image in FIG. 4, the present disclosure is not limited in this regard. For example, by using multiple cameras, as described previously herein, a 3-D layout could be generated in accordance with the method 300 from FIG. 3 and/or the control system 100 from FIG. 1, in accordance with various embodiments.

In various embodiments, the loaded layout 400 produced from method 300 may allow visualization and referencing of a position in which components or baskets are loaded in the vacuum furnace. In various embodiments, the loaded layout 400 may further allow better traceability during post-processing root cause analysis, quality investigations or the like.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method of generating a loaded layout in a vacuum furnace corresponding to an actual layout in the vacuum furnace during operation of the vacuum furnace, the method comprising:

receiving, via a processor, a visual data of a loading process of the vacuum furnace from a camera, the visual data including a first image showing a first row of components and a second image showing a second row of components;

comparing, via the processor, the first image and the second image of the visual data to a predetermined maximum capacity layout for the vacuum furnace, the predetermined maximum capacity layout including X number of baskets wide by Y number of baskets long by Z number of baskets high; and arranging, via the processor, the visual data into the loaded layout in response to comparing the visual data, wherein the loaded layout includes a placeholder image in a location in the actual layout in the vacuum furnace, the placeholder image indicating a basket in the predetermined maximum capacity layout lacks a corresponding component in the first row of components or the second row of components.

2. The method of claim 1, further comprising sending, via the processor, the loaded layout to a display device.

3. The method of claim 1, further comprising storing, via the processor, the loaded layout for a batch load in the furnace for at least one of traceability, root cause analysis, or quality investigations.

4. The method of claim 3, wherein:

the visual data includes a visual image for each row of components disposed in the vacuum furnace, and the loaded layout displayed on the display device includes the visual image for each row corresponding a respective location a component in the visual image was in the vacuum furnace.

5. The method of claim 1, wherein the visual data is video data.

6. The method of claim 1, wherein the loaded layout includes a two-dimensional image.

7. The method of claim 1, wherein the loaded layout includes a three-dimensional image.

8. A method, comprising:

capturing a visual data of a vacuum furnace loading process, the visual data including a first image of a first row of components disposed on a loading stand and a second image of a second row of components disposed on the loading stand in a vacuum furnace, the loading stand configured to be placed in the vacuum furnace; and arranging the first image and the second image into a layout image, the layout image including the first image, the second image, and location indicators, the location indicators corresponding to a position of components within the vacuum furnace during operation of the vacuum furnace, wherein the layout image includes a placeholder image indicating a component in a predetermined maximum capacity layout lacks a corresponding component in the first row of components or the second row of components.

9. The method of claim 8, wherein capturing the visual data is captured via a camera.

10. The method of claim 9, wherein the visual data is video data.

11. The method of claim 9, wherein the first image and the second image were captured as still images.

12. The method of claim 8, wherein the layout image is a three-dimensional image.

13. The method of claim 8, wherein the first row of components includes a first basket with a first set of components and a second basket with a second set of components.

14. The method of claim 13, wherein the first set of components are different from the second set of components.

15. A control system for vacuum furnace post processing, the control system comprising:

a camera configured to be disposed with a line of sight to a loading stand;

a controller configured to operably couple to the camera, the controller configured to:

receive, through the camera, visual data corresponding to a loading process of a plurality of baskets on the loading stand, each basket in the plurality of baskets having a component disposed therein the visual data including a first image showing a first row of components and a second image showing a second row of components; and arrange the visual data into a loaded layout, the loaded layout corresponding to an actual layout of the plurality of baskets during after the loading process, wherein the loaded layout includes a placeholder image in a location in the actual layout in the vacuum furnace, the placeholder image indicating a basket in a predetermined maximum capacity layout lacks a corresponding component in the first row of components or the second row of components.

16. The control system of claim 15, wherein the controller is further configured to compare the visual data to a predetermined maximum capacity layout prior to arranging the visual data.

17. The control system of claim 16, wherein arranging the visual data into the loaded layout is in response to comparing the visual data to the predetermined maximum capacity layout.

18. The control system of claim 15, further comprising a plurality of cameras, the plurality of cameras including the camera.

19. The control system of claim 18, wherein the controller is further configured to generate a three-dimensional image for the loaded layout.

20. The control system of claim 15, wherein the first row of baskets is disposed between the loading stand and the second row of baskets.

* * * * *